US011679972B2

(12) United States Patent
El-Zabet

(10) Patent No.: US 11,679,972 B2
(45) Date of Patent: Jun. 20, 2023

(54) FUNNEL

(71) Applicant: Omeed El-Zabet, Newmarket (CA)

(72) Inventor: Omeed El-Zabet, Newmarket (CA)

( * ) Notice: Subject to any disclaimer, the term of this patent is extended or adjusted under 35 U.S.C. 154(b) by 0 days.

(21) Appl. No.: 17/525,665

(22) Filed: Nov. 12, 2021

(65) Prior Publication Data

US 2023/0122948 A1 Apr. 20, 2023

Related U.S. Application Data

(60) Provisional application No. 63/255,504, filed on Oct. 14, 2021.

(51) Int. Cl.
*B67C 11/02* (2006.01)
*B67C 11/00* (2006.01)

(52) U.S. Cl.
CPC ..... *B67C 11/02* (2013.01); *B67C 2011/30* (2013.01)

(58) Field of Classification Search
CPC ..... B67C 11/02; B67C 2011/30
USPC ..... 141/340
See application file for complete search history.

(56) References Cited

U.S. PATENT DOCUMENTS 641,267 A * 1/1900 Cahill ..... B67C 11/02 141/297
760,069 A * 5/1904 Hunter ..... B67C 11/02 D7/700
2,608,843 A * 9/1952 Kennedy ..... A47J 47/16 248/224.7
5,899,246 A * 5/1999 Cummins ..... B67C 9/00 D7/700
7,013,934 B1 * 3/2006 Hicok ..... B67C 11/00 141/297
7,302,976 B1 * 12/2007 Bultman ..... B67C 11/02 141/367
7,503,142 B1 * 3/2009 Uhl ..... A01M 1/106 141/331
2007/0256755 A1 * 11/2007 King ..... B67C 11/02 141/340
2015/0096644 A1 * 4/2015 Lee ..... B65D 47/32 141/1

FOREIGN PATENT DOCUMENTS

CN 102464290 A * 5/2012
GB 428128 A * 5/1935 ..... B67C 11/02

* cited by examiner

*Primary Examiner* — Timothy L Maust
(74) *Attorney, Agent, or Firm* — Nyssa Inc.

(57) ABSTRACT

There is provided a funnel having a body forming a conduit for a flowable material. The body has an inlet to receive the flowable material and an outlet to output the flowable material. The flowable material is to move from the inlet to the outlet along an axis of material movement. The body has a stem portion proximate the outlet, the stem portion for being at least partially received into a corresponding inlet of a receptacle for transferring the flowable material into the receptacle. The funnel also has one or more fins positioned in the stem portion, which fins extend from an outer surface of the body laterally to the axis of material movement. The one or more fins are to abut against an inner surface of the corresponding inlet of the receptacle when the stem portion is at least partially received in the corresponding inlet of the receptacle.

10 Claims, 13 Drawing Sheets

FUNNEL

CROSS-REFERENCE TO RELATED APPLICATION

This application claims priority from U.S. Provisional Patent Application No. 63/255,504, filed on Oct. 14, 2021, which is incorporated herein by reference in its entirety.

FIELD

The present specification relates to funnels, and in particular to funnels for transferring flowable materials.

BACKGROUND

Transferring a flowable material into a receptacle with a relatively narrow inlet may be challenging because some of the material may fail to enter the inlet and cause spillage and waste.

SUMMARY

An aspect of the present specification provides a funnel comprising: a body forming a conduit for a flowable material, the body having an inlet to receive the flowable material and an outlet to output the flowable material, the flowable material to move from the inlet to the outlet along an axis of material movement, the body having a stem portion proximate the outlet, the stem portion for being at least partially received into a corresponding inlet of a receptacle for transferring the flowable material into the receptacle; and one or more fins positioned in the stem portion, the one or more fins extending from an outer surface of the body laterally to the axis of material movement, the one or more fins to abut against an inner surface of the corresponding inlet of the receptacle when the stem portion is at least partially received in the corresponding inlet of the receptacle.

At least a portion of the body may have a frustoconical shape.

The body may comprise an inlet portion proximate the inlet, the inlet portion connected to the stem portion; and the inlet portion may have a first frustoconical shape having a first taper and the stem portion may have a second frustoconical shape having a second taper different from the first taper.

At least one of the fins may have a circular perimeter.

The funnel may comprise a first fin, a second fin, and a third fin, spaced from one another along the axis of material movement, the first fin being closest to the inlet, the third fin being closest to the outlet, and the second fin being disposed between the first fin and the third fin.

The first fin, the second fin, and the third fin may have a circular perimeter and a first diameter, a second diameter, and a third diameter respectively; and the first diameter may be larger than the second diameter, and the second diameter may be larger than the third diameter.

The second fin may be positioned about midway between the first fin and the third fin along the axis of material movement.

The one or more fins may be to resiliently deform against the inner surface of the corresponding inlet of the receptacle when the stem portion is at least partially received in the corresponding inlet of the receptacle.

The one or more fins may comprise silicone.

The one or more fins may be integrally formed with the stem portion of the body.

At least one of the fins may comprise a through hole.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements, and have been solely selected for ease of recognition in the drawings.

DETAILED DESCRIPTION

Figure 1:
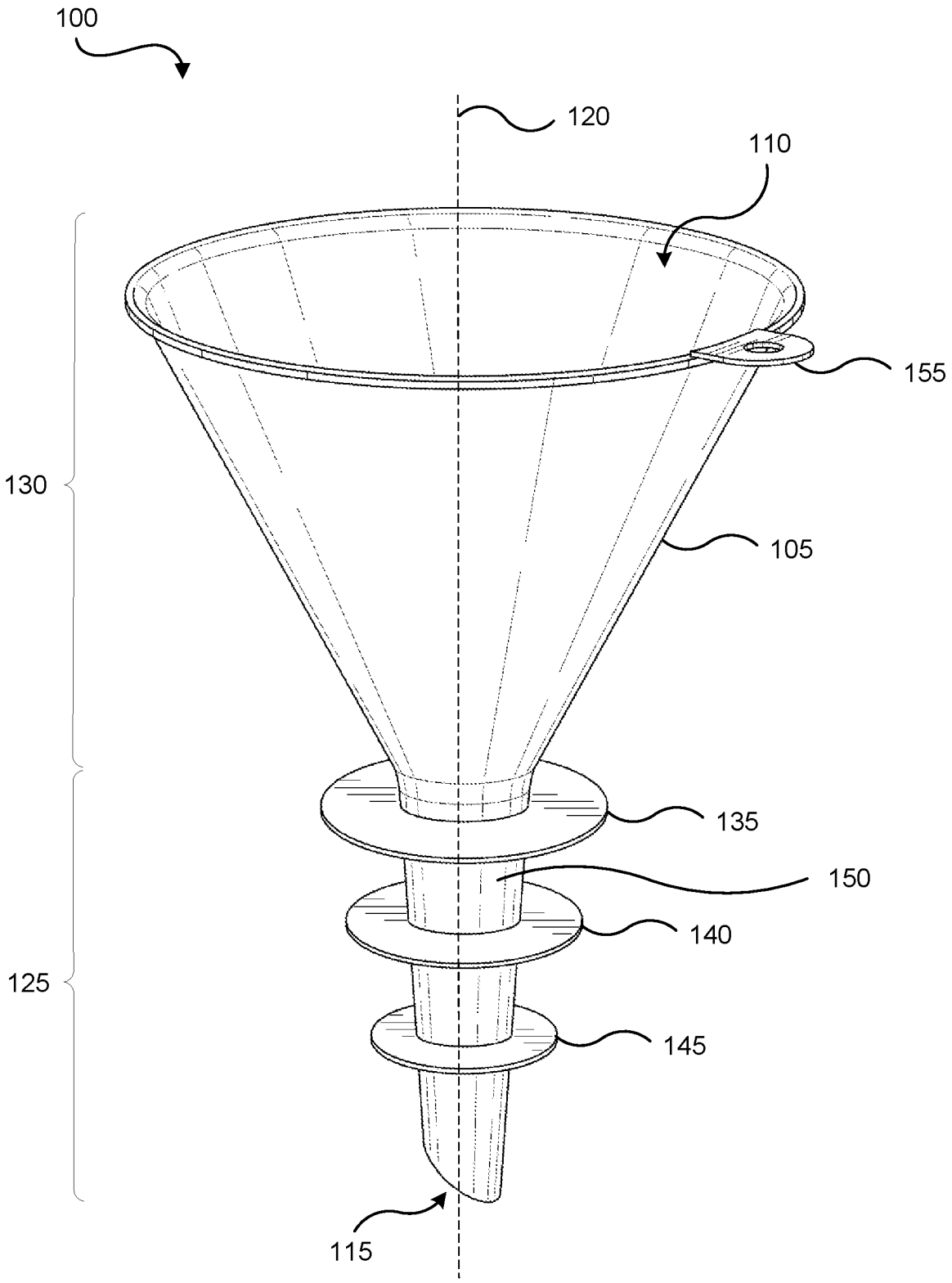
FIG. 1 shows a top perspective view of an example funnel, in accordance with a non-limiting implementation of the present specification.

In the following description, certain specific details are set forth in order to provide a thorough understanding of various disclosed implementations. However, one skilled in the relevant art will recognize that implementations may be practiced without one or more of these specific details, or with other methods, components, materials, and the like.

Moreover, in the following description, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this specification, language of "at least one of X, Y, and Z" and "one or more of X, Y and Z" can be construed as X only, Y only, Z only, or any combination of two or more items X, Y, and Z (e.g., XYZ, XY, YZ, ZZ, and the like). Similar logic can be applied for two or more items in any occurrence of "at least one . . . " and "one or more . . . " language.

Unless the context requires otherwise, throughout the specification and claims which follow, the word "comprise" and variations thereof, such as, "comprises" and "comprising" are to be construed in an open, inclusive sense, that is as "including, but not limited to."

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the implementations.

In order to reduce the likelihood of spillage and waste when transferring a flowable material into a receptacle a funnel may be used to facilitate the transfer of the material into the receptacle. Some funnels may fit loosely into the inlet of the receptacle. As such, when the flowable material is deposited into the funnel, the funnel may move or tip causing some of the material to be spilled.

In addition, some funnels may have an inlet portion connected to a stem portion terminating in an outlet of the funnel. When the flowable material is deposited into the inlet portion, the inlet portion of the funnel may become top-heavy, further exacerbating the tipping or moving challenges that may be associated with funnels that fit loosely into a corresponding receptacle. Moreover, if the transfer of the flowable material is to happen on a sloped terrain or if the inlet of the receptacle is at an angle to the horizontal, a funnel may become more susceptible to moving or tipping when the flowable material is transferred into the inlet portion of the funnel.

FIG. 1 shows a top perspective view of an example funnel 100, which may be used for transferring a flowable material into a receptacle. Funnel 100 comprises fins 135, 140, and 145, which may reduce the likelihood of funnel 100 moving or tipping in operation, thereby reducing the likelihood of spillage or waste of the flowable material. In this description, "fins" may generically refer to one, several, or all of the fins of a funnel. Funnel 100 comprises a body 105 which forms a conduit for a flowable material. Body 105 has an inlet 110 to receive the flowable material, and an outlet 115 to output the flowable material.

In some examples, the flowable material may comprise a liquid, a liquid-based suspension or mixture, a slurry, and the like. Moreover, in some examples, the flowable material may comprise the granular solid, a powder, and the like. In some examples, the flowable material may comprise a material that can flow through a conduit. Moreover, in some examples, the flowable material may comprise a material that can flow through a conduit under its own weight. When deposited in funnel 100, the flowable material may move from inlet 110 to outlet 115 along an axis 120 of material movement.

Figure 3:
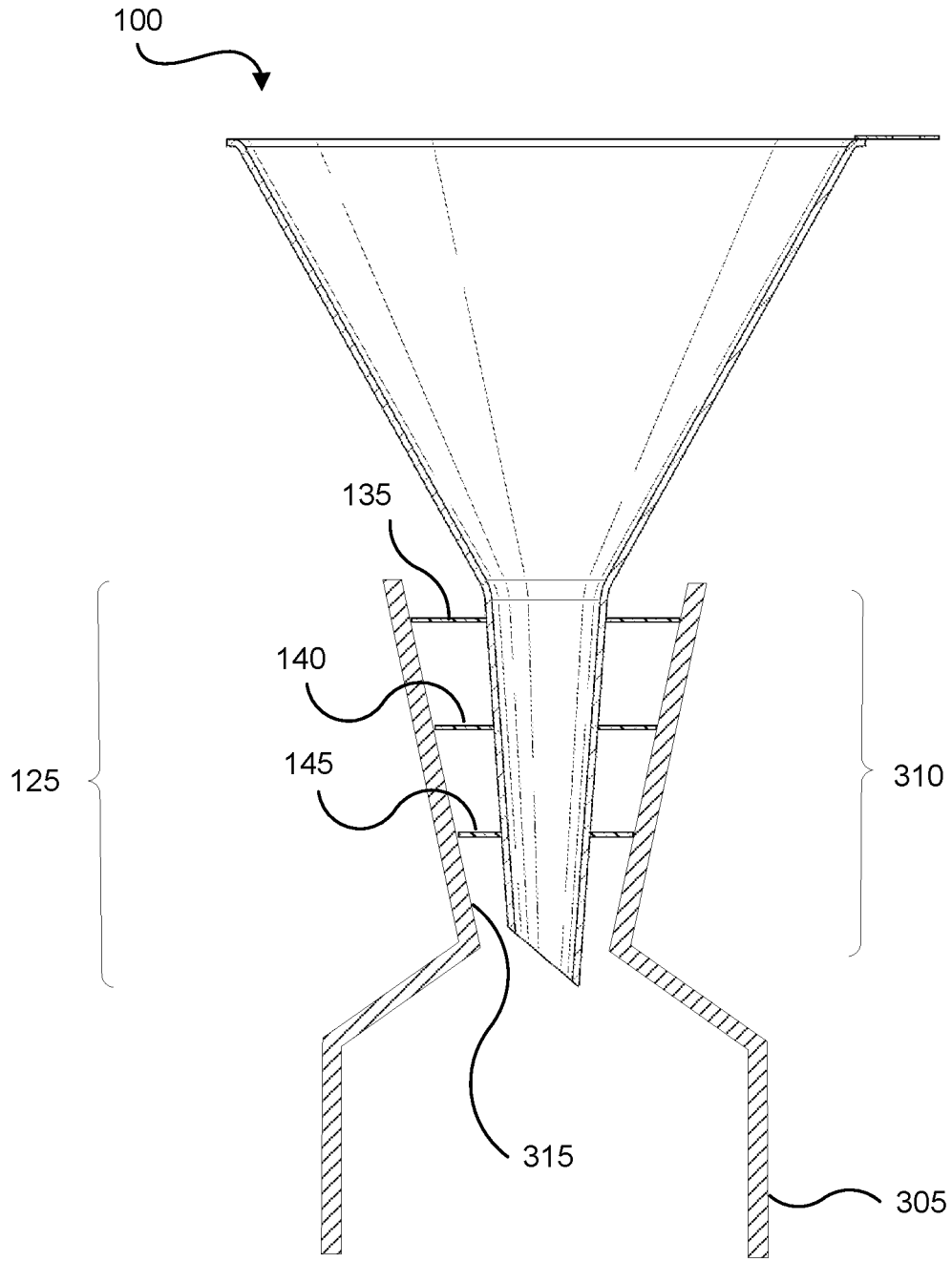
FIG. 3 shows anther cross-sectional view of the funnel of FIG. 1.

Moreover, body 105 may have a stem portion 125 proximate outlet 115 and an inlet portion 130 proximate inlet 110. As shown in FIG. 1, stem portion 125 and inlet portion 130 are connected to one another. In operation, stem portion 125 may be at least partially received into an inlet of a receptacle for transferring the flowable material into that receptacle. An example of such a receptacle is shown in FIG. 3.

Funnel 100 also comprises three fins 135, 140, and 145 positioned in stem portion 125 of funnel 100. These fins extend from an outer surface 150 of body 105 laterally to axis 120 of material movement. In operation, one or more of fins 135, 140, and 145 abut against an inner surface of the inlet of the receptacle when stem portion 125 is at least partially received in the inlet of the receptacle. By abutting against the inlet of the receptacle, the fins reduce the movement of funnel 100 relative to the inlet of the receptacle. In other words, by abutting against the inlet of the receptacle, the fins create a relatively tighter fit between funnel 100 and the inlet of the receptacle. By creating a tighter fit between funnel 100 and the inlet of the receptacle, and by reducing movement of funnel 100 relative to the receptacle, the fins may reduce the likelihood of funnel 100 moving or tipping in operation and causing spillage of the flowable material.

As shown in FIG. 1, funnel 100 also comprises a tab 155 proximate inlet 110. Tab 155 may be secured to body 105, or may be formed integrally with body 105. Tab 155 may be used to hold funnel 100 for purposes of operation, transport, storage, and the like. Tab 155 also comprises a through hole, which may be used to hang funnel 100 for storage purposes, and the like. While FIG. 1 shows tab 155 having a through hole, it is contemplated that in some examples the tab need not have a through hole. Moreover, while FIG. 1 shows funnel 100 as having tab 155, it is contemplated that in some examples funnel 100 need not have a tab.

In addition, as shown in FIG. 1, both stem portion 125 and inlet portion 130 of funnel 100 have frustoconical shapes. Moreover, stem portion 125 has a first frustoconical shape having a first taper, and inlet portion 130 has a second frustoconical shape having a second taper. As can be seen in FIG. 1, stem portion 125 and inlet portion 130 have different degrees or amounts of taper. It is also contemplated that in some examples, different portions of funnel 100 may have shapes different than those shown in FIG. 1. For example, the stem portion need not be tapered, and in some examples may be cylindrical, and the like. The inlet portion may also have a shape other than as frustoconical shape.

Furthermore, while FIG. 1 shows body 105 as having an inlet portion and a stem portion with different tapers, it is contemplated that in some examples the body of the funnel may have a single shape or taper throughout. In other words, in some examples the funnel need not have differently-shaped inlet and stem portions. Moreover, while FIG. 1 shows inlet 110 as having a circular shape, it is contemplated that in some examples the inlet may have a shape other than circular.

Moreover, in FIG. 1 body 105 forms a closed conduit for the flowable material. It is also contemplated that in some examples the body of the funnel may form an at least partially open conduit such as a channel, a trough, or the like. Furthermore, while FIG. 1 shows axis 120 of material movement as being straight, it is contemplated that in some examples the path of movement of the flowable material from the inlet to the outlet of the funnel, and the corresponding axis of material movement, may have a shape other than straight. For example, the shape may be segmented, curved, and the like.

In the example funnel 100 shown in FIG. 1, stem portion 125 is shaped and sized to be partially or fully received in an inlet of the receptacle. As such, fins 135, 140, and 145 are positioned in stem portion 125 to allow the fins to interact with the inlet of the receptacle when funnel 100 is in operation. It is also contemplated that in some examples, a different portion or even all of the funnel may be designed to be at least partially received in the inlet of the receptacle.

In such examples, the fins may be positioned in those portions of the funnel that may be at least partially received in the inlet of the receptacle.

In some examples, the fins may be formed separately from body 105, and then secured to body 105. Moreover, in some examples, one or more of the fins may be integrally formed with a portion of the body 105, such as stem portion 125. In funnel 100, the fins extend radially relative to axis 120 of material movement, and form about a right angle with axis 120. It is contemplated that in some examples, the angle between the fins and axis 120 may be different than a right angle. Moreover, in some examples, the angle between the fins and axis 120 may be an angle greater than 0° and smaller than 180°. This angle may be selected to allow the fins to interact with the inner surface of the inlet of the receptable, to reduce the likelihood of movement of the funnel relative to the receptacle in operation. It is also contemplated that in some examples, all of the fins need not form the same angle with axis 120, and that some of the fins may form different angles with axis 120.

Furthermore, in some examples, in addition to abutting the inner surface of the inlet of the receptacle, the fins may be resiliently deformed against the inner surface of the inlet of the receptacle when stem portion 125 is at least partially received in the inlet of the receptacle. The resilient force of such resiliently deformed fins against the inlet of the receptacle may further reduce the likelihood of movement of funnel 100 relative to the receptacle. In addition, the use of resiliently deformable fins may allow funnel 100 to be used with receptacles having inlets of different sizes. Such resiliently deformable fins would deform less when stem portion 125 is received inside a receptacle with a relatively wider inlet, and would perform relatively more when stem portion 125 is received inside a receptacle with a relatively narrower inlet.

In some examples, such resiliently deformable fins may comprise a resiliently deformable material such as an elastomer, composite material, and the like. Moreover, in some examples, one or more of the fins may comprise silicone, and the like. It is contemplated that in some examples, the fins may be more easily resiliently deformable than the stem or body of the funnel. Such fins may also be described as being more flexible than the stem or body of the funnel. For example, the body or stem of the funnel may comprise a relatively less flexible material such as a plastic, metal, or the like, while the fins of the funnel may comprise a relatively more flexible material such as silicone, and the like. In some examples, depending on the choice of the material of the body and the fins, the fins may either be formed separately from the body and then secured to the body, or formed integrally with a portion of the body.

As shown in FIG. 1, fins 135, 140, and 145 have a circular perimeter. In addition, the fins are spaced from one another along axis 120 of material movement. Fin 135 is closest to inlet 110, fin 145 is closest to outlet 115, and fin 140 is disposed between fin 135 and fin 145. Moreover, as shown in FIG. 1, the fins have different diameters from one another. Fin 135 has a diameter that is larger than the diameter of fin 140, which has a diameter that is in turn larger than the diameter of fin 145. Furthermore, fin 140 is positioned about midway between fin 135 and fin 145 along axis 120 of material movement.

Having fins of different diameters may allow at least some of the fins to interact with a range of sizes of inlets of receptacles. For a relatively narrower inlet, relatively more of the fins may abut or interact with the inlet. Such a relatively greater extent of interaction may allow for a tighter or more secure fit between the funnel and the inlet of the receptacle. For a relatively wider inlet, relatively fewer of the larger diameter fins may interact with that relatively wider inlet. If all the fins were to be made as large as the largest fin, the fins might present too much resistance when the fins are to be received in a relatively narrower inlet of a receptacle. By having a range of fin sizes or diameters, funnel 100 may be operable with a greater range of sizes of inlets of receptacles.

Figure 11:
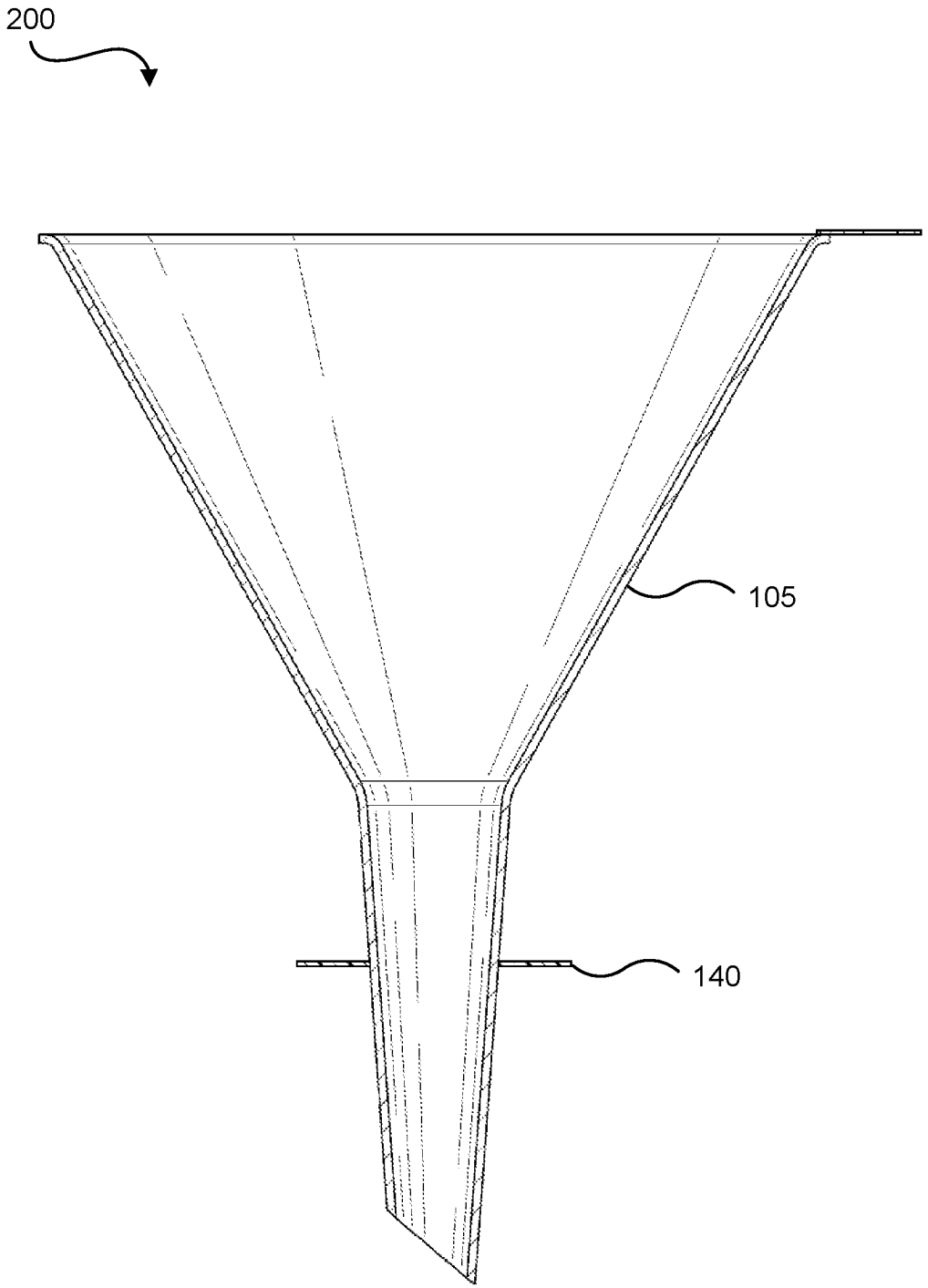
FIG. 11 shows a cross-sectional view of another example funnel, in accordance with a non-limiting implementation of the present specification.
Figure 12:
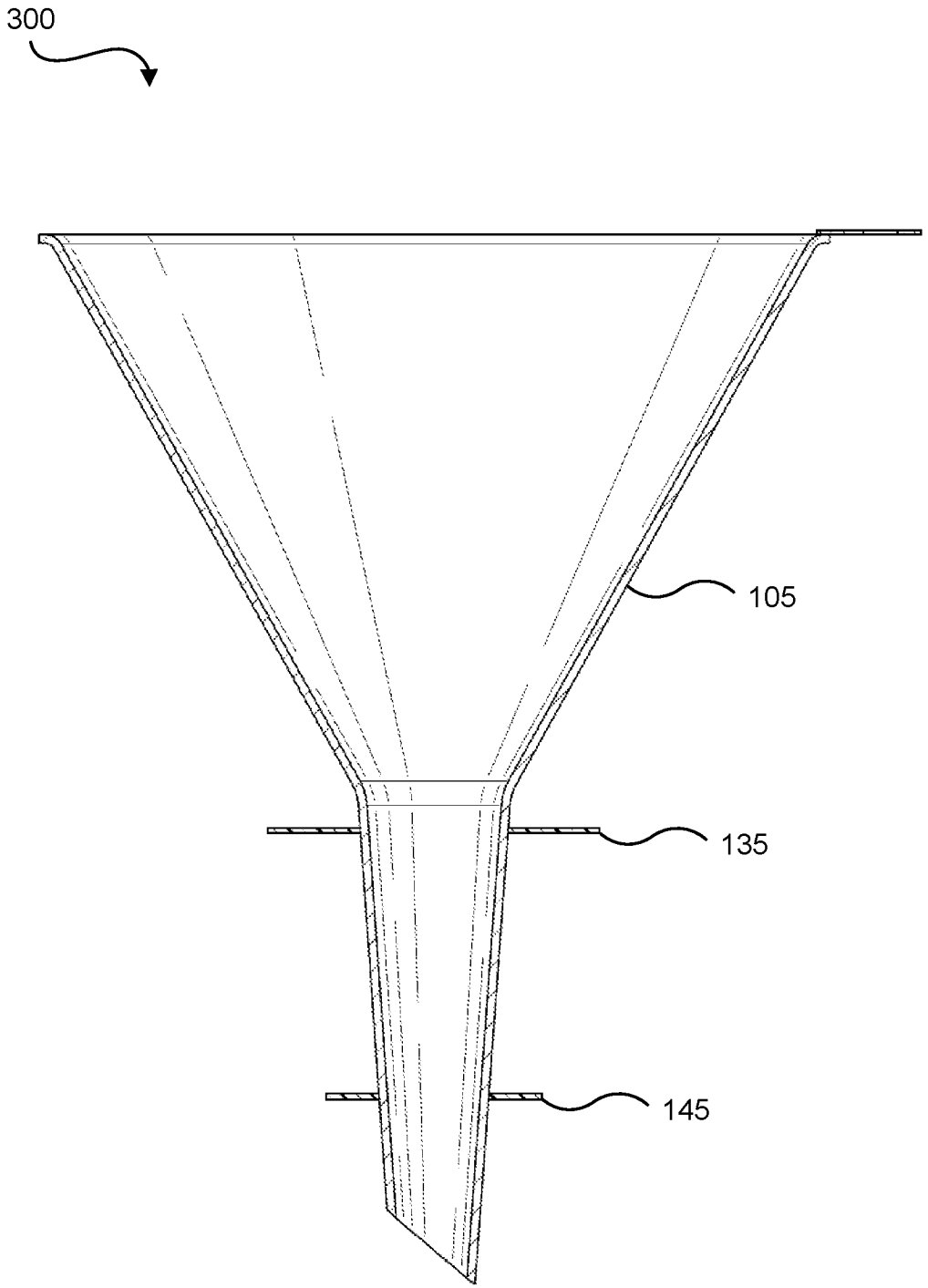
FIG. 12 shows a cross-sectional view of yet another example funnel, in accordance with a non-limiting implementation of the present specification.

While FIG. 1 shows a given number, shapes, relative sizes, and positioning of fins, it is contemplated that in some examples, funnel 100 may have a different number, shapes, sizes, or positioning of one or more fins. For example, funnel 100 may have a number of fins that is different than three. FIGS. 11 and 12 show example funnels that have one fin and two fins respectively. It is also contemplated that in some examples the funnel may have four or more fins.

Figure 13:
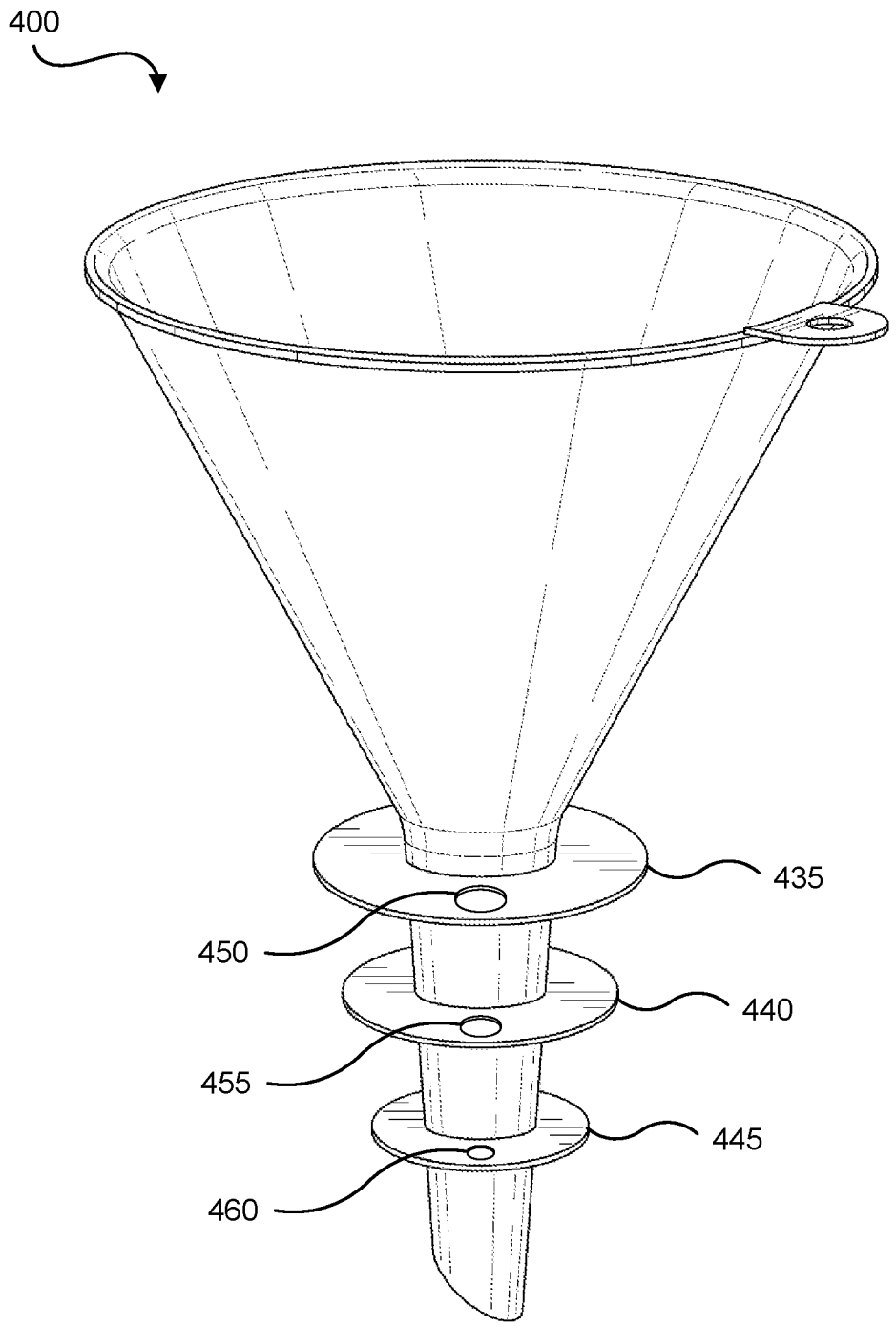
FIG. 13 shows a top perspective view of yet another example funnel, in accordance with a non-limiting implementation of the present specification.

In addition, in FIG. 1 the fins are shown as having a circular shape. It is contemplated that in some examples the fins may have a shape that is different than circular. For example, in some examples, the fins may have a shape that is square, star-shaped, hexagonal, octagonal, and the like. Moreover, in FIG. 1 the fins are shown as being continuous. It is contemplated that in some examples, one or more of the fins may each have one or more through holes. Such holes may allow for venting as the flowable material is transferred into the receptacle. Moreover, such holes may also allow for less material to be used for making the fins. As example of such fins with through holes is shown in FIG. 13.

In addition, it is contemplated that in some examples the relative sizes or diameters of the fins may be different than those shown in FIG. 1. It is also contemplated that the relative positioning or distribution of the fins along the body of the funnel may also be different than those shown in FIG. 1.

Figure 2:
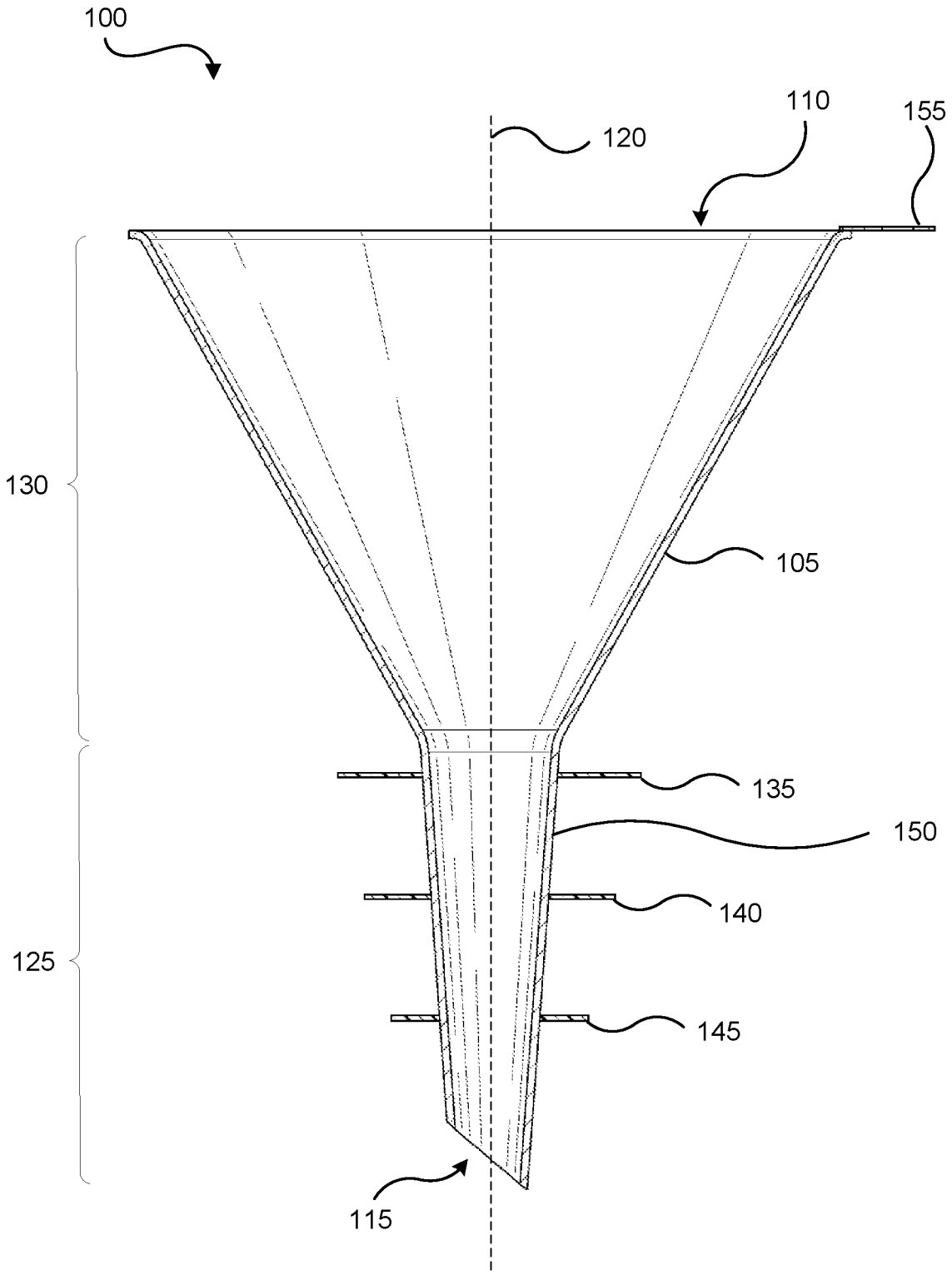
FIG. 2 shows a cross-sectional view of the funnel of FIG. 1.

FIG. 2 shows a cross-sectional view of funnel 100. FIG. 3 shows funnel 100 in operation, whereby stem portion 125 is received inside an inlet 310 of an example receptacle 305. For ease of illustration, only a portion of receptacle 305 is shown in FIG. 3. As shown in FIG. 3, fins 135, 140, and 145 abut an inner surface 315 of inlet 310 of receptacle 305 when stem portion 125 is received inside inlet 310. As described above, this abutting of fins against inlet 310 reduces the likelihood of funnel 100 moving relative to receptacle 305 and spilling the flowable material being transferred into receptacle 305. In addition, while FIG. 3 shows all three fins of funnel 100 abutting inner surface 315 of inlet 310, it is contemplated that in some examples some of the fins may not abut the inlet of the receptacle.

Furthermore, while FIG. 3 shows fins 135, 140, and 145 preserving their shape when stem portion 125 is received inside inlet 310, it is contemplated that in some examples one or more of the fins may be resiliently deformed when the stem portion is received inside the inlet of the receptacle. Moreover, while FIG. 3 shows inlet 310 as having a given shape and size, it is contemplated that funnel 100 may be used with a range of receptacles having inlets of shapes and sizes different than those of inlet 310.

Figure 4:
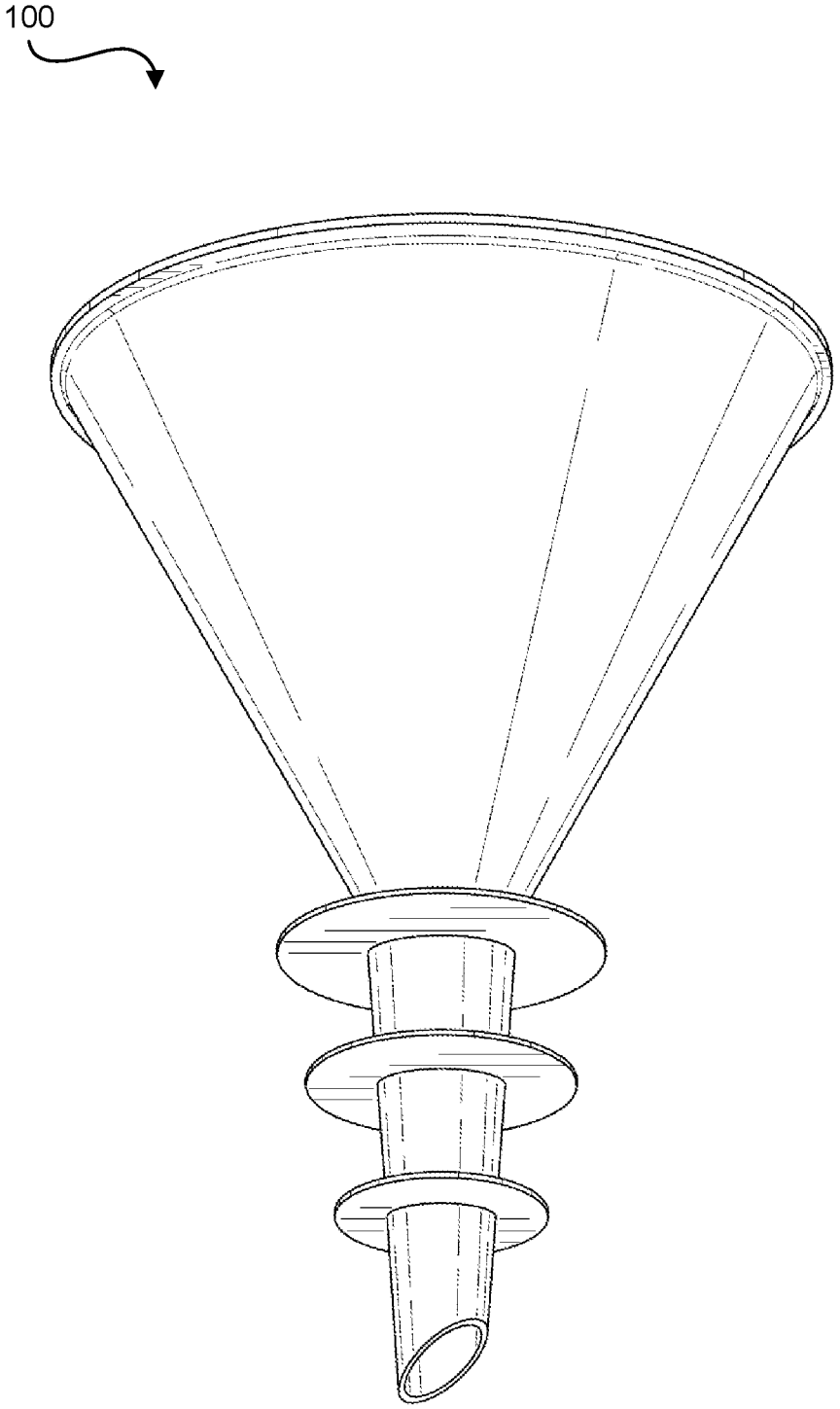
FIG. 4 shows a bottom perspective view of the funnel of FIG. 1.
Figure 5:
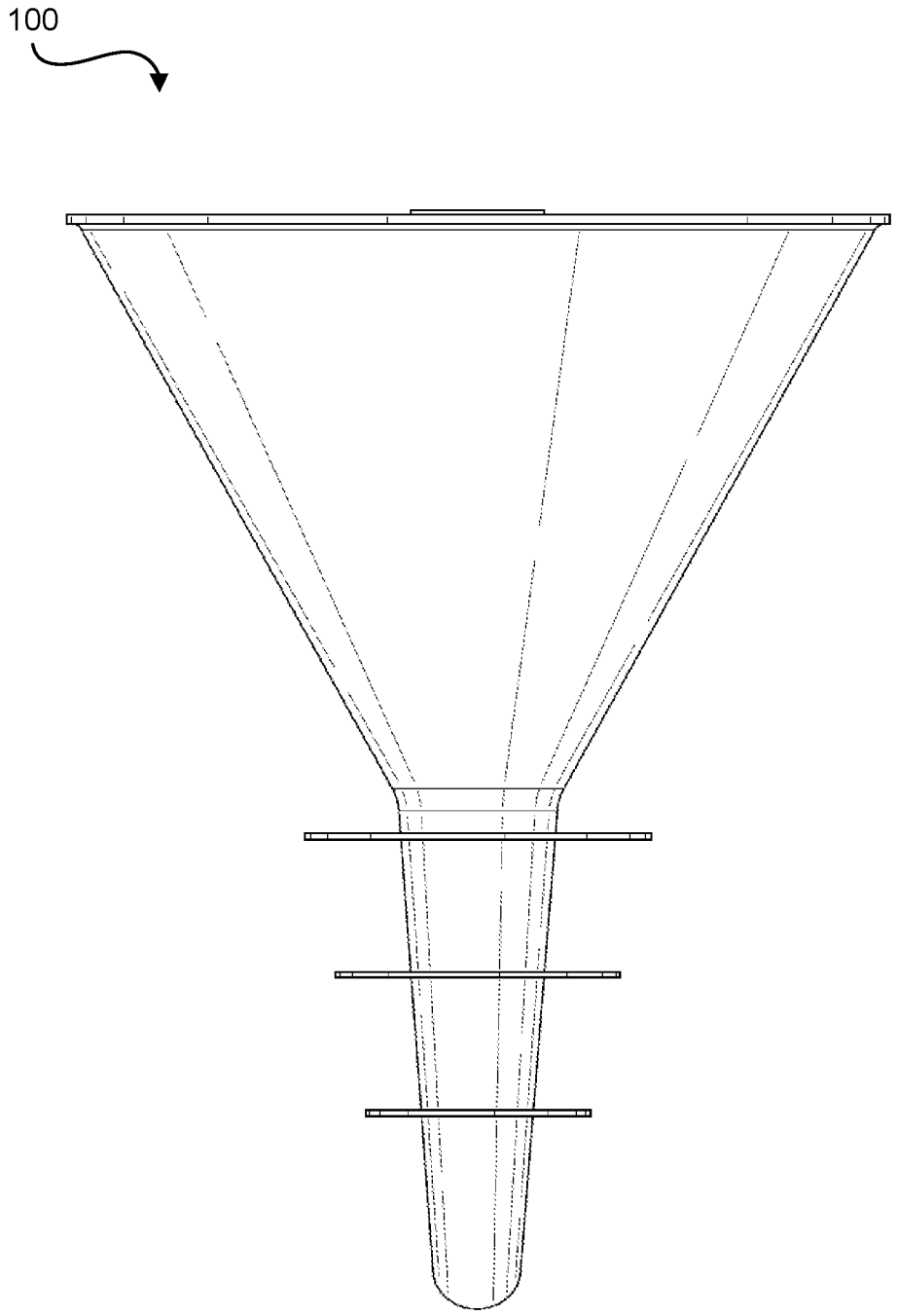
FIG. 5 shows a front side elevation view of the funnel of FIG. 1.
Figure 6:
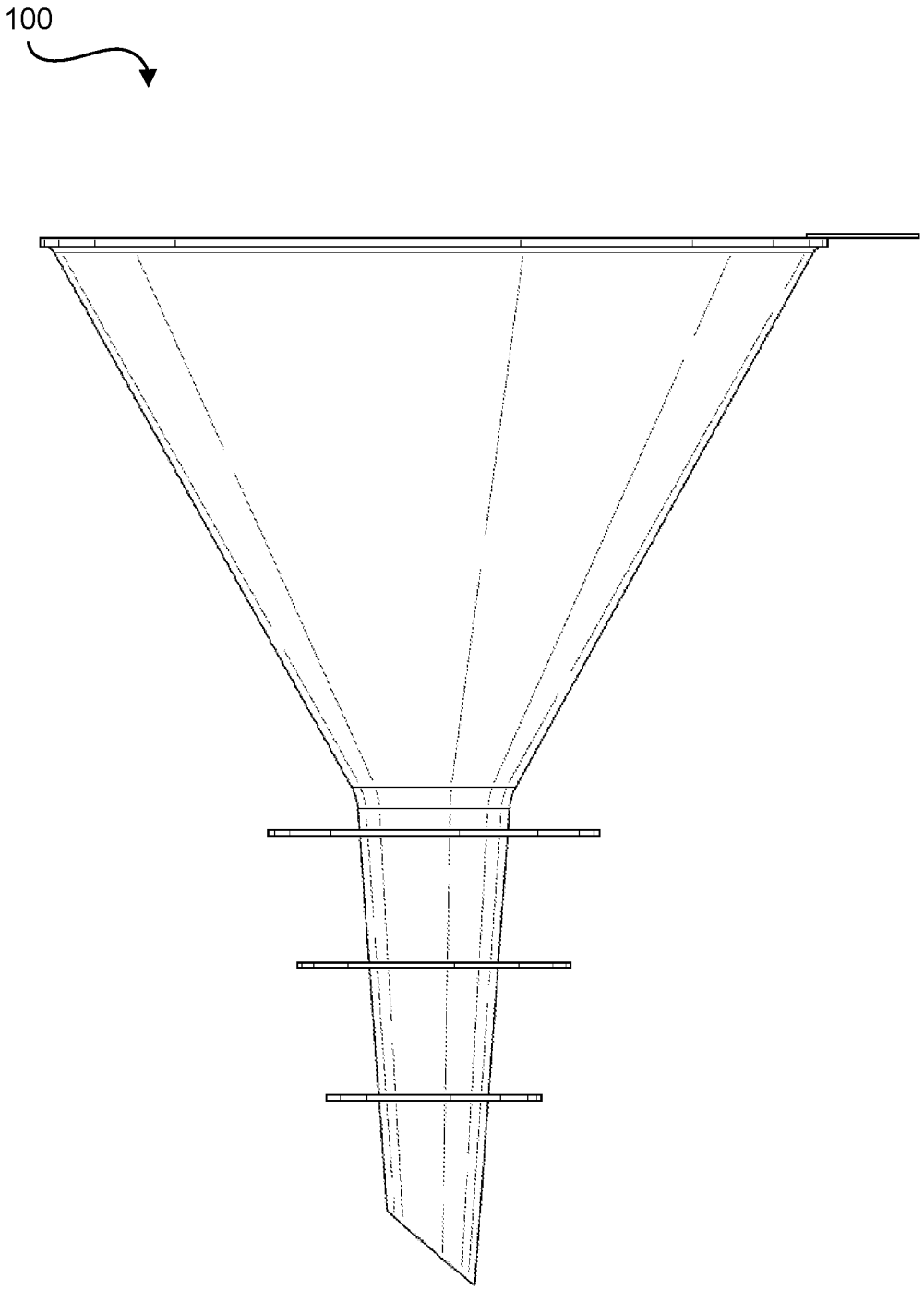
FIG. 6 shows a left side elevation view of the funnel of FIG. 1.
Figure 7:
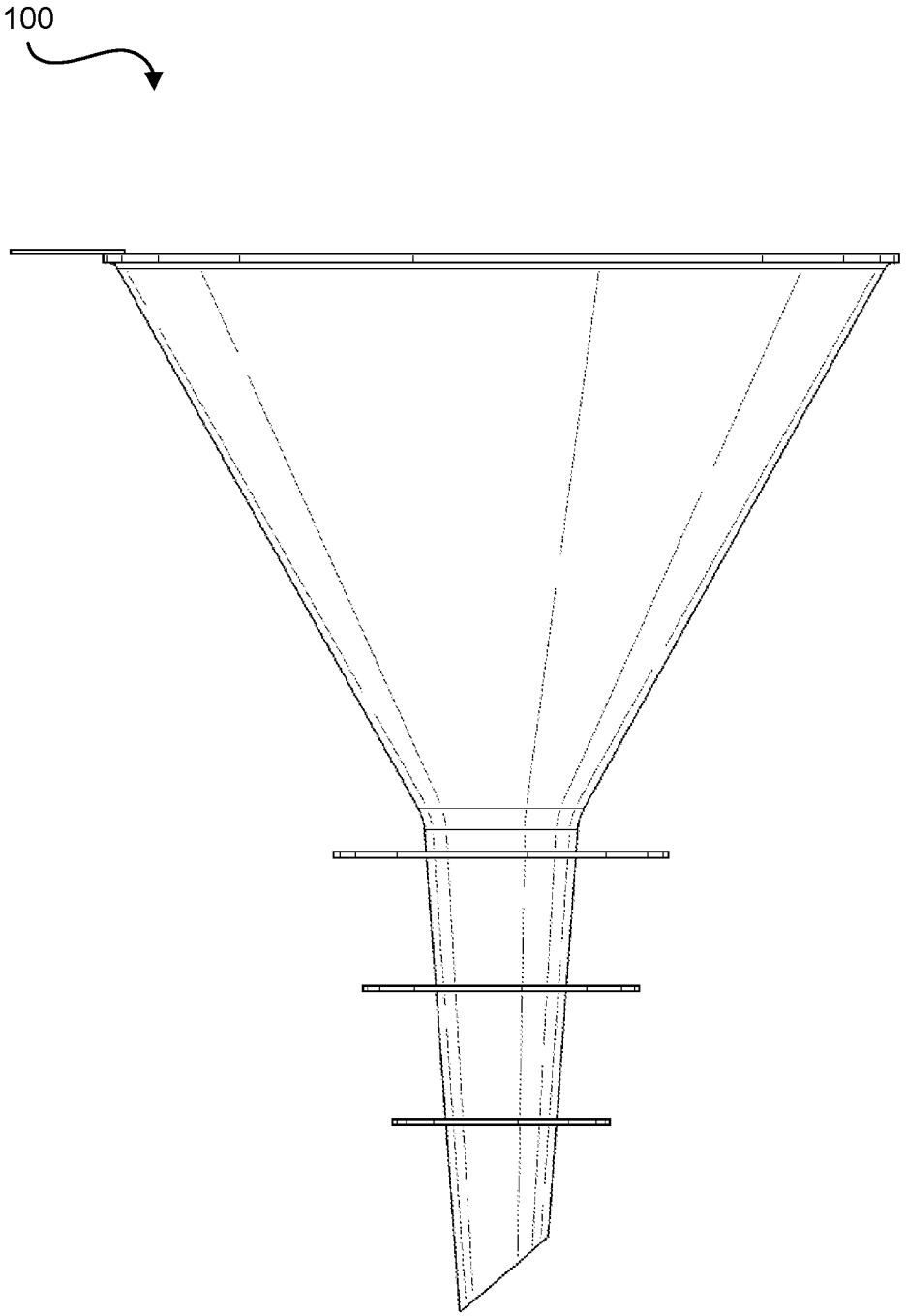
FIG. 7 shows a right side elevation view of the funnel of FIG. 1.
Figure 8:
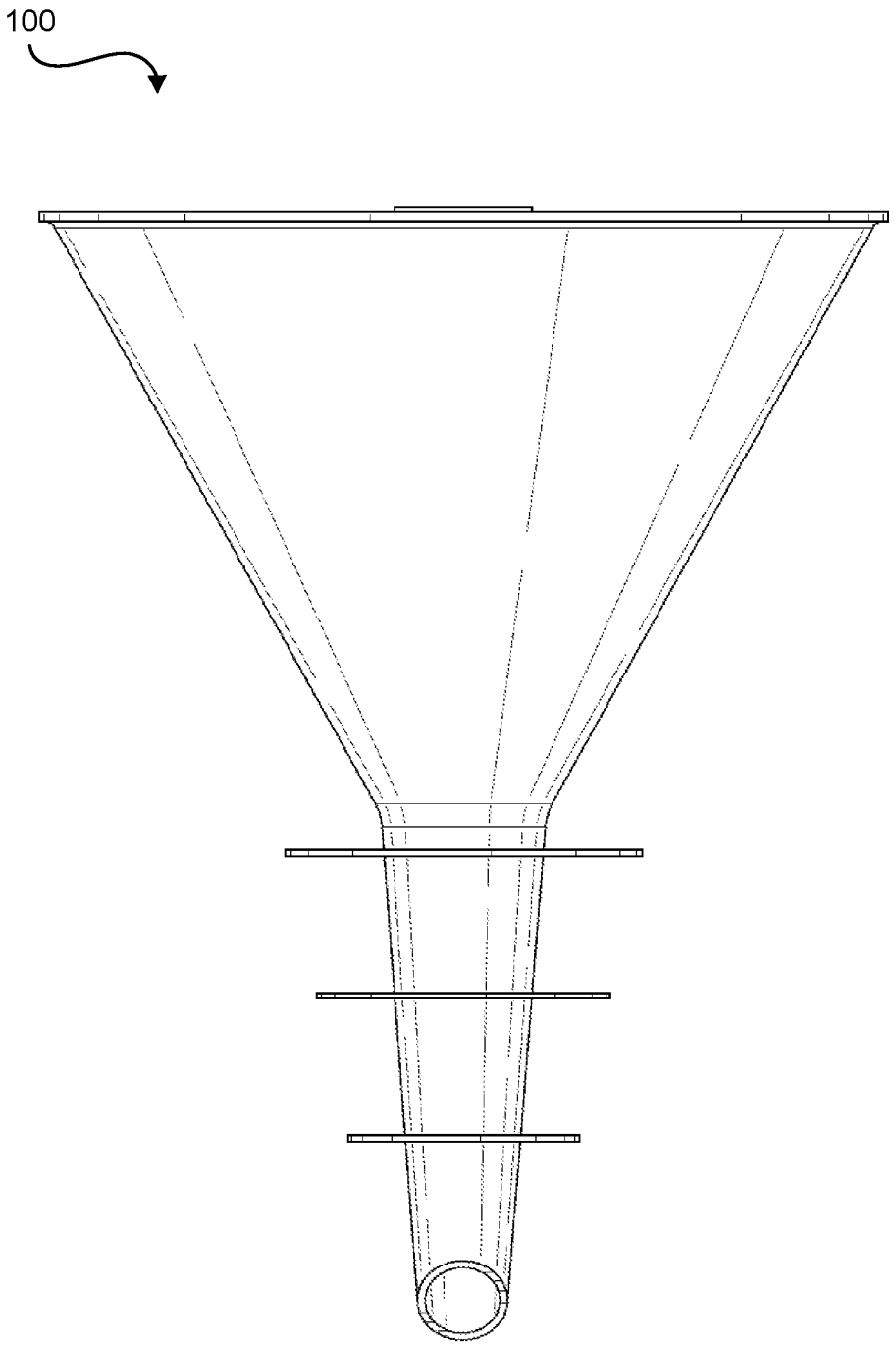
FIG. 8 shows a rear side elevation view of the funnel of FIG. 1.
Figure 9:
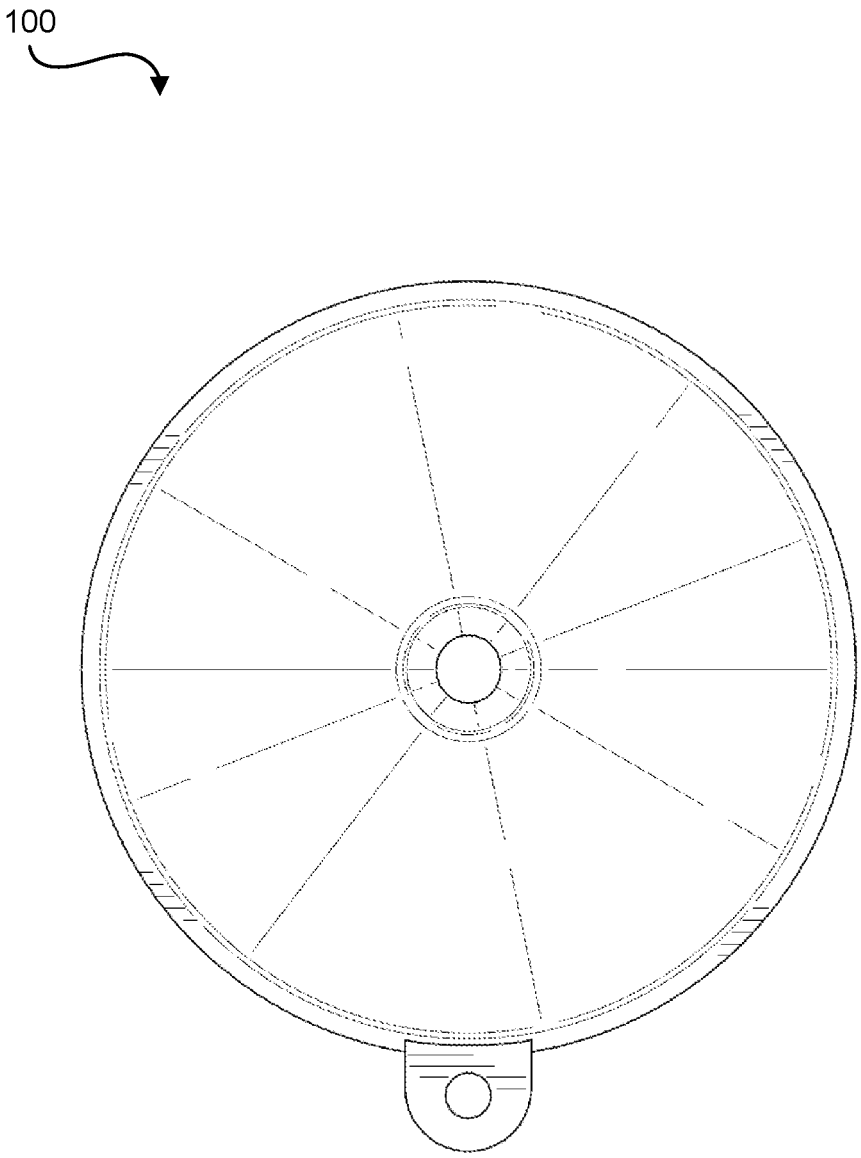
FIG. 9 shows a top plan view of the funnel of FIG. 1.
Figure 10:
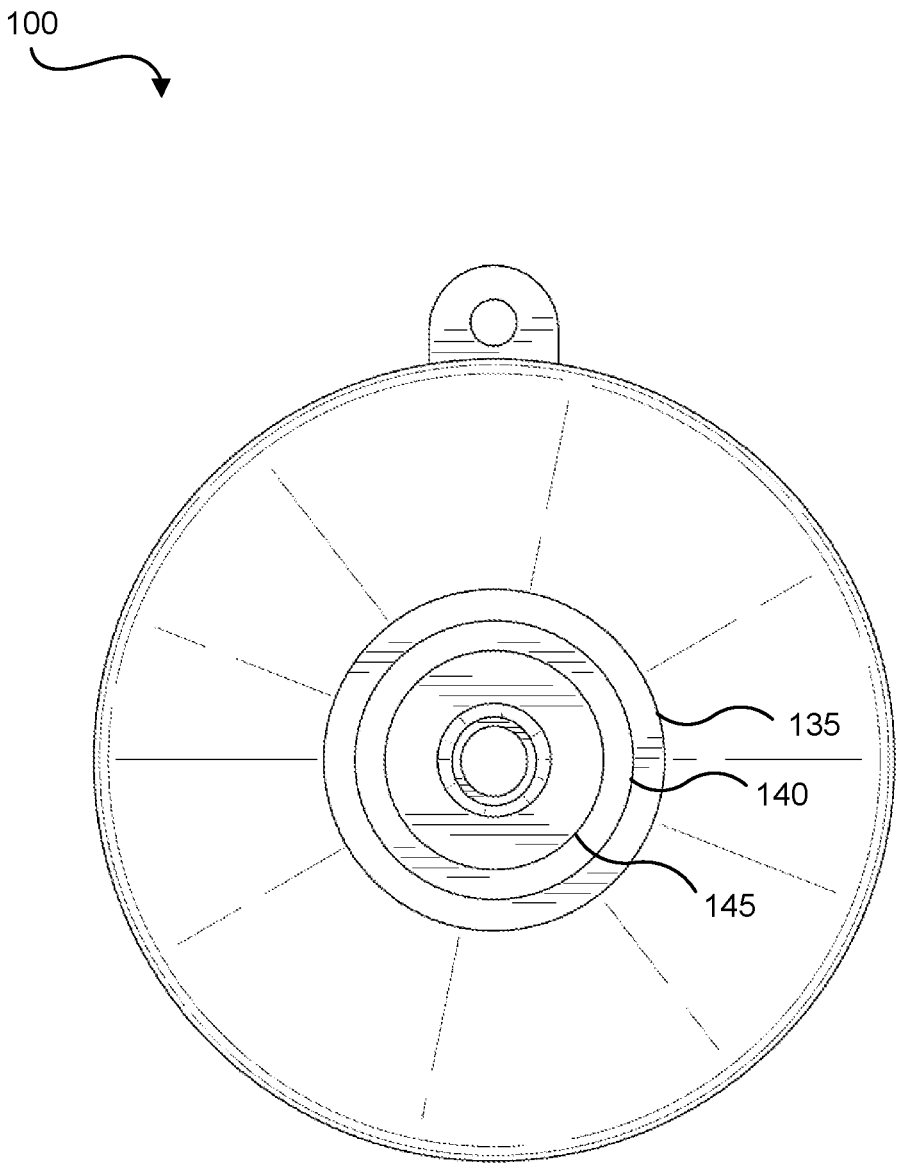
FIG. 10 shows a bottom plan view of the funnel of FIG. 1.

Turning now to FIG. 4 a bottom perspective view is shown of funnel 100. FIG. 5 shows a front side elevation view of funnel 100. FIG. 6 shows a left side elevation view of funnel 100. FIG. 7 shows a right side elevation view of funnel 100. Moreover, FIG. 8 shows a rear side elevation view of funnel 100. FIG. 9 shows a top plan view of funnel 100. FIG. 10 shows a bottom plan view of funnel 100.

FIG. 11 in turn shows a cross-sectional view of an example funnel 200. Funnel 200 is similar to funnel 100, with a difference being that funnel 200 has one fin in its stem portion. FIG. 12 shows a cross-sectional view of another example funnel 300. Funnel 300 is also similar to funnel 100, with a difference being that funnel 300 has two fins in the stem portion. Funnels with different numbers, positions, sizes, and shapes of fins are also contemplated.

FIG. 13 shows a top perspective view of another example funnel 400. Funnel 400 is also similar to funnel 100, with a difference being that each of the fins of funnel 400 has a through hole. Funnel 400 comprises fins 435, 440, and 445 which may be similar respectively to fins 135, 140, and 145 of funnel 100. A difference between fins 435, 440, and 445 and fins 135, 140, and 145 is that fins 435, 440, and 445 respectively comprise or define through holes 450, 455, and 460.

As discussed above, in operation holes 450, 455, and 460 may allow for enhanced venting when funnel 400 is used to transfer a flowable material into a receptacle. In addition, the holes may reduce the amount of material used to make the fins, and allow for corresponding reductions in funnel weight, cost, and environmental impact. While FIG. 13 shows each fin as having one hole, it is contemplated that in some examples one or more of the fins may each have more than one hole. In addition, it is contemplated that in some examples one or more of the fins need not have a hole. It is also contemplated that in some examples, the shape, size, number, and positioning of the hole(s) in each fin may be different than those shown in FIG. 13.

In some examples the fins may have a non-continuous shape, such as a web shape, a truss shape, and the like. In some examples, the through holes defined by such fins may have shapes other than a circular shape. Moreover, it is contemplated that in some examples, instead of or in addition to the through holes, one or more of the fins may have an uncommonly-shaped perimeter. Such a perimeter with an uncommon shape may be shaped to be less likely to form a substantially air-tight seal with the inlet of the receptacle, and therefore be less likely to pose a hindrance to venting in operation. An example of such a perimeter may include a perimeter with a semi- or part-circular cut-out removed the perimeter. Cut-outs of other shapes are also contemplated. Other examples of such uncommonly-shaped perimeters may include a star-shaped perimeter, an undulating curved perimeter, and the like.

While FIGS. 1-13 show fins that are sheet-like in their shape, it is contemplated that in some examples the funnel may comprise, instead of or in addition to fins, projections from the outer surface of the body that have shapes that are other than sheet-like. These projections may have a variety of shapes such as ribs, rods, bristles, collars, bumps, and the like. These projections may also interact with the inner surface of an inlet of a receptacle to reduce the likelihood of the funnel moving relative to the receptable in operation.

Throughout this specification and the appended claims, infinitive verb forms are often used. Examples include, without limitation: "to receive," "to output," "to abut," "to resiliently deform," and the like. Unless the specific context requires otherwise, such infinitive verb forms are used in an open, inclusive sense, that is as "to, at least, receive," to, at least, output," "to, at least, abut," and so on.

The above description of illustrated example implementations, including what is described in the Abstract, is not intended to be exhaustive or to limit the implementations to the precise forms disclosed. Although specific implementations of and examples are described herein for illustrative purposes, various equivalent modifications can be made without departing from the spirit and scope of the disclosure, as will be recognized by those skilled in the relevant art. Moreover, the various example implementations described herein may be combined to provide further implementations.

In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A funnel comprising:

a body forming a conduit for a flowable material, the body having an inlet to receive the flowable material and an outlet to output the flowable material, the flowable material to move from the inlet to the outlet along an axis of material movement, the body having a stem portion proximate the outlet, the stem portion for being at least partially received into a corresponding inlet of a receptacle for transferring the flowable material into the receptacle; and two or more fins positioned in the stem portion and spaced from one another along the axis of material movement, the fins extending from an outer surface of the body laterally to the axis of material movement, the fins to abut against an inner surface of the corresponding inlet of the receptacle when the stem portion is at least partially received in the corresponding inlet of the receptacle;

wherein each of the fins comprises a through hole.

2. The funnel of claim 1, wherein at least a portion of the body has a frustoconical shape.

3. The funnel of claim 2, wherein:

the body comprises an inlet portion proximate the inlet, the inlet portion connected to the stem portion; and the inlet portion has a first frustoconical shape having a first taper and the stem portion has a second frustoconical shape having a second taper different from the first taper.

4. The funnel of claim 1, at least one of the fins has a circular perimeter.

5. The funnel of claim 1, wherein the funnel comprises a first fin, a second fin, and a third fin, spaced from one another along the axis of material movement, the first fin being closest to the inlet, the third fin being closest to the outlet, and the second fin being disposed between the first fin and the third fin.

6. The funnel of claim 5, wherein:

the first fin, the second fin, and the third fin have a circular perimeter and a first diameter, a second diameter, and a third diameter respectively; and the first diameter is larger than the second diameter, and the second diameter is larger than the third diameter.

7. The funnel of claim 5, wherein the second fin is positioned about midway between the first fin and the third fin along the axis of material movement.

8. The funnel of claim 1, wherein the one or more fins are to resiliently deform against the inner surface of the corresponding inlet of the receptacle when the stem portion is at least partially received in the corresponding inlet of the receptacle.

9. The funnel of claim 1, wherein the one or more fins comprise silicone.

10. The funnel of claim 1, wherein the one or more fins are integrally formed with the stem portion of the body.

* * * * *